US007347497B2

(12) United States Patent
Fujihara et al.

(10) Patent No.: US 7,347,497 B2
(45) Date of Patent: Mar. 25, 2008

(54) MANIPULATION DEVICE FOR WHEELCHAIR FOOTRESTS

(75) Inventors: Kouji Fujihara, 3-36, Kuchi-tanaka 1-chome, Amagasaki-shi, Hyogo (JP); Takaaki Fujihara, Amagasaki (JP)

(73) Assignee: Kouji Fujihara, Amagasaki-Shi, Hyogo (JP)

( * ) Notice: Subject to any disclaimer, the term of this patent is extended or adjusted under 35 U.S.C. 154(b) by 0 days.

(21) Appl. No.: 11/684,160

(22) Filed: Mar. 9, 2007

(65) Prior Publication Data

US 2008/0001461 A1 Jan. 3, 2008

(30) Foreign Application Priority Data

Jun. 30, 2006 (JP) ..... 2006-180659

(51) Int. Cl.
*A61G 5/02* (2006.01)

(52) U.S. Cl. ..... 297/423.29; 280/304.1; 297/423.35

(58) Field of Classification Search ..... 297/423.25, 297/423.29, 423.35, 423.37, 69, DIG. 4; 280/304.1

See application file for complete search history.

(56) References Cited

U.S. PATENT DOCUMENTS 4,410,215 A * 10/1983 McKean et al. ..... 297/423.19
5,358,266 A * 10/1994 Roth et al. ..... 280/304.1
5,497,676 A * 3/1996 Barnard ..... 297/463.1
5,779,316 A * 7/1998 Sugawa et al. ..... 297/423.26
5,890,766 A * 4/1999 Tsai ..... 297/423.28
6,422,653 B1 * 7/2002 Szczepanski et al. .. 297/423.29
6,880,845 B1 * 4/2005 Broyles et al. ..... 280/304.1

FOREIGN PATENT DOCUMENTS

JP 2003-310664 11/2003
JP 2005-192959 7/2005
JP 2006-158957 6/2006

* cited by examiner

*Primary Examiner*—Peter R. Brown
(74) *Attorney, Agent, or Firm*—Antonelli, Terry, Stout & Kraus, LLP.

(57) ABSTRACT

A manipulation device is for wheelchair footrests that have a pair of shafts (8) extending forwards from opposite forward sides of the main frame (2) and a pair of foot plates (9) pivoted at lateral portions to the shafts. This device has manual levers (21) at the forward sides and actuating means (40) that connects the levers (21) to foot plates (9) and consists of a resilient tube (41), a metal wire (42) and a setting retainer (43) for securing the tube to the wire. The tube (41) can elongate in response to an extraordinary tension exceeding a normal stress imparted to said tube, and the wire (42) loosely inserted in the tube (41) can alter an exposed length. An end of each wire (42) is connected to the foot plate (9) at its rear portion located near the shaft (8) pivoting the foot plate. An end of each tube (41) is connected to the manual lever (21) operating to pull up the tube (41) with the wire (42) such that the foot plate (9) rotates and rises to the upright idle position.

5 Claims, 7 Drawing Sheets

MANIPULATION DEVICE FOR WHEELCHAIR FOOTRESTS

FIELD OF THE INVENTION

The present invention relates to such a manipulation device for wheel-chair footrests that foot plates thereof supporting the feet of a user of this wheelchair are capable of being operated.

BACKGROUND ART

Some wheelchair footrests of the types known in the art comprise a pair of shafts extending forwards from lateral sides of a main frame, and a pair of foot plates pivoted to the shafts. The foot plates are allowed to swivel between their horizontal (closed) positions facing close to each other and their upright idle (open) positions. However, a retention mechanism will prevent each foot plate from any unintentional fall from its open upright position to closed horizontal position. Such a mechanism usually comprises a spring, threaded members and/or the like intervening between the pivoting portions of foot plate and shaft, thereby imparting thereto a strong frictional resistance.

In use, whenever getting on or off the wheelchair, every handicapped or aged user or any assistant or helper attending on the user must use their hands or feet to put the foot plates out of the way. In detail, the foot plates are forced to their upright open position before the user sits on the wheelchair. He or she will then turn the foot plates towards each other to take the horizontal and closed (operative) position until they lie still to support his or her feet.

Usually, such a direct and manual or kicking operation to open or close the foot plates is not so easy to the user or helper. In particular, if the user sitting on the wheelchair is a handicapped or aged person, it may be considerably difficult to bend his or her body forwards and deeply to handle the foot plates. In a case wherein a helper operates the foot plates, he or she has to bow or squat down in front of the wheelchair in order to rotate the foot plates. This causes a pain to him or her, and a narrow forward space will make the operation very difficult. Further, bare hands of the user or helper touching the foot plates will catch an amount of dirt and a number of bacteria that souls of his or her shoes have picked up and collected from streets, hospital floors or lavatories. This is a hygienic problem that may spread any infectious diseases in hospitals, so that the wheelchair of the described types have been washed and sterilized periodically.

Some proposals have been made to resolve or diminish the drawback and problems inherent in the prior art wheelchairs. In those proposals, a manual lever is disposed on one side of a main frame, and an actuator operatively connects the lever to each foot plate. When the foot plates are opened or closed, the user need no longer touch them directly with his or her bare hands. Such manipulation devices as shown in the Patent References 1 and 2 (Japanese Patent Laying-Open Gazette Nos. 2003-310664 and 2005-192959 respectively) have assisted the user to easily get on or off a wheelchair and have facilitated the helper's work.

The manipulation device disclosed in Patent Reference 1 is intended to operate foot plates in a wheelchair, and comprises a pair of urging means (e.g., coiled springs) for always biasing upwards the foot plates to turn towards their upright open position. This device further comprises a pair of actuating means (e.g., wires) to operatively connect each foot plate to a manual lever. Those wires act on both the foot plates so as to turn them against the coiled springs towards a transverse and operative (closed) position where they lie close to each other.

The wheelchair described in Patent Reference 1 is somewhat complicated in structure due to the urging means such as coiled springs for always biasing upwards the foot plates towards their upright open (idle) position. Besides, it would be difficult to wash out dust and bacteria that have migrated from the foot plates to the urging means. Wrong operation of the manual levers may possibly cause the urged foot plates to leap up to the upright open (idle) position, thus bring about some difficulty in use. In addition, the actuating means are slack wires to permit any intended change in height of each foot plate. Therefore, it any foreign matter caught the slack wires, the manual levers would make a malfunction.

The foot plate manipulating device described in Patent Reference 2 had been proposed previously by the present inventors. However, it had not suggested any details with respect to structure of an actuating means for connecting each foot plate to a manual lever. The present invention was accomplished through a number of trials and researches made by use to render feasible the device of Reference 2.

SUMMARY OF THE INVENTION

Objects to be Achieved

The present invention was made in view of the problems and requirements noted above, and its object is to provide wheelchair footrests with a manipulation device that is simpler in structure, easier to handle and more beneficial in safety.

Solutions

In order to achieve the object, the invention proposes a manipulation device for wheelchair footrests that are disposed at a frontal portion of a main frame and may comprise, as in the prior art, a pair of shafts extending forwards from opposite forward and lateral regions of the main frame and a pair of foot plates pivoted at lateral end portions thereof to the shafts. The manipulation device may further comprise manual levers also disposed at the lateral regions of said main frame and actuating means that operatively connect the manual levers to the foot plates, so that the foot plates are allowed to turn between an operative (closed) position where they extend sideways close to each other and an upright idle (open) position where they are ready to support the feet of a user. The actuating means may substantially consist of a resilient tube, a metal wire and a setting retainer that serves to secure the resilient tube to the metal wire, wherein the tube is capable of elongation in response to an extraordinary tension exceeding a normal stress imparted to said tube, and wherein the wire is loosely inserted in the tube to such an adjustable extent as to alter an exposed length of said wire. An end of each metal wire is connected to a rear portion of the foot plate, with this portion being located adjacent to the shaft that holds and pivots said foot plate, and an end of each resilient tube is connected to the manual lever so that this lever is operable to pull up the tube united with the wire in such a manner that the foot plate rotates and rises to its upright idle position.

The present manipulation device for footrests will make it unnecessary to manually contact the foot plates, and thus any user sitting on this wheelchair can close or open them in a comfortable manner. Also, any helper attending on the user has no longer to bend his or her body or squat but can easily operate the foot plates. This manipulation device is nevertheless so simple in structure that any existing wheelchairs can be equipped with it readily. Further, if and when the height of foot plates is adjusted, the metal wire inserted in the resilient tube may be displaced relative thereto a proper distance, either outwards or inwards. Such a regulation system of the actuating means eliminates any excessive slackness from both the tube and wire which the actuating means comprises. Now, the combination of said wire with said tube remains stretched straight, lest any problem or malfunction should take place that has otherwise been caused by any obstacle catching the prior art actuating means usually standing slacked.

It also is to be noted that the manual lever would be operated erroneously and immoderately by the user having his or her feet rested on the foot plates. In such an event, the resilient tube absorbs an extraordinary tension due to its yielding elongation, so as to protect the device from any forcible stress. Even if the user lifted his or her feet off the foot plates, the resilient tube would shrink gently not to cause them to leap up.

Preferably, a clearance may be provided between the outer periphery of the forward extending shaft and the inner peripheral surface of a hole that penetrates each foot plate to form therein a pivot portion. In this case, a frictional resistance against rotation of the foot plate relative to the shaft will be reduced. With the manual lever being relaxed, each foot plate will spontaneously rotate due to gravitational force to thereby return to its transverse operative (closed) position. This means that any external force need not be applied to the foot plates which are then required to extend sideways towards each other.

Advantages Afforded Herein

As summarized above, the manipulation device now provided for the footrests is simple in structure, and its operation is easier and safer even if it is readily mounted on any existing wheelchairs currently available on the market. This device is not only of a simplified structure but also has such an open mechanical feature as facilitating access thereto for the purpose of cleaning and sterilization.

Where the user or helper wants to alter the height of foot plates, he or she just has to change the exposed length of the wire protruding out of the tube. Such an adjustment of the actuating means enables its constituent parts, that is the wire and the tube, to be always aligned generally straight without any excessive slackness. The actuating means has no fear of getting in the way or catching any obstacle, thus obviating any accidents that would be caused by a slack wire.

If the user or helper did wrong to forcibly handle the manual lever while resting feet on the foot plates, then it would be subjected to a stress stronger than a normal operational tension. However, the resilient tube will show an elastic elongation to compensate such an abnormal stress and protect this device from any superfluour external force. If in such a situation the user moved his or her feet off said plates, then the tube would shrink so slowly as to prevent them from dangerously leaping up.

THE PREFERRED EMBODIMENTS

Now some embodiments of the present invention will be described referring to the accompanying drawings.

Figure 1:
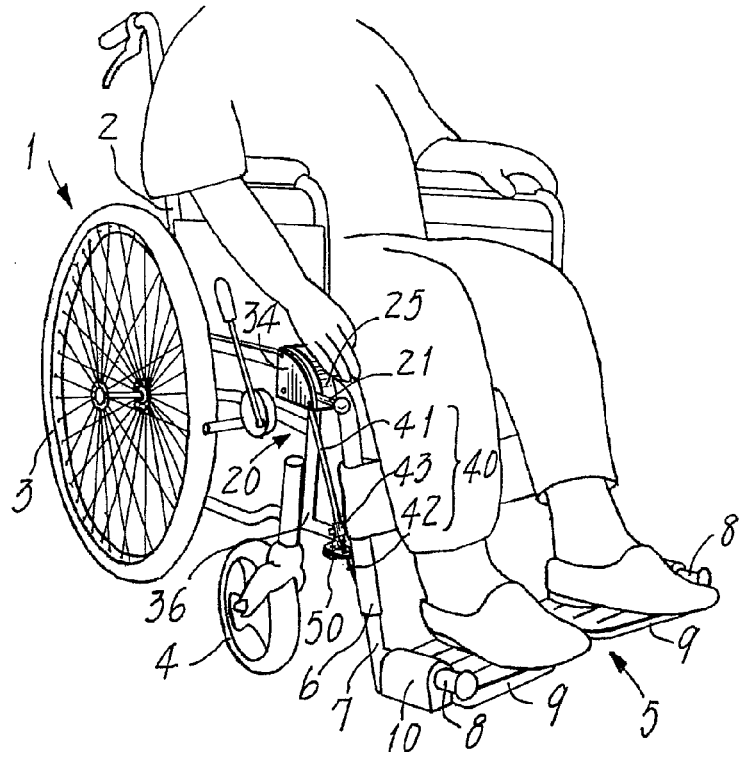
FIG. 1 is a perspective view of a wheelchair shown in use and comprising a manipulation device of the invention.
Figure 2:
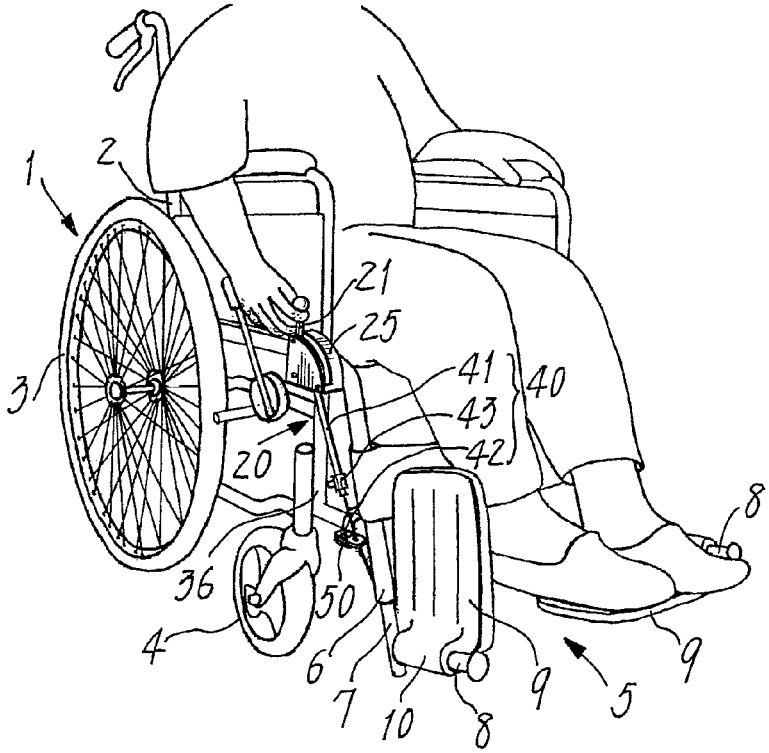
FIG. 2 is a perspective view of the manipulation device shown in FIG. 1 and being operated.

FIGS. 1 and 2 show a wheelchair 1 provided with a manipulation device that is constructed herein for footrests each comprising a foot plate. Except for the manipulation device, this wheelchair 1 is of the same structure in its entirety as those of some types now available on the market. Therefore, only an outline of the wheelchair will be given here. A main frame 2 is generally composed of some lengths of metal pipes, and attached to this frame are a pair of large-diameter rear wheels 3 and a pair of small-diameter front wheels 4. Footrests 5 are disposed at a frontal end region of the main frame 2.

Figure 3:
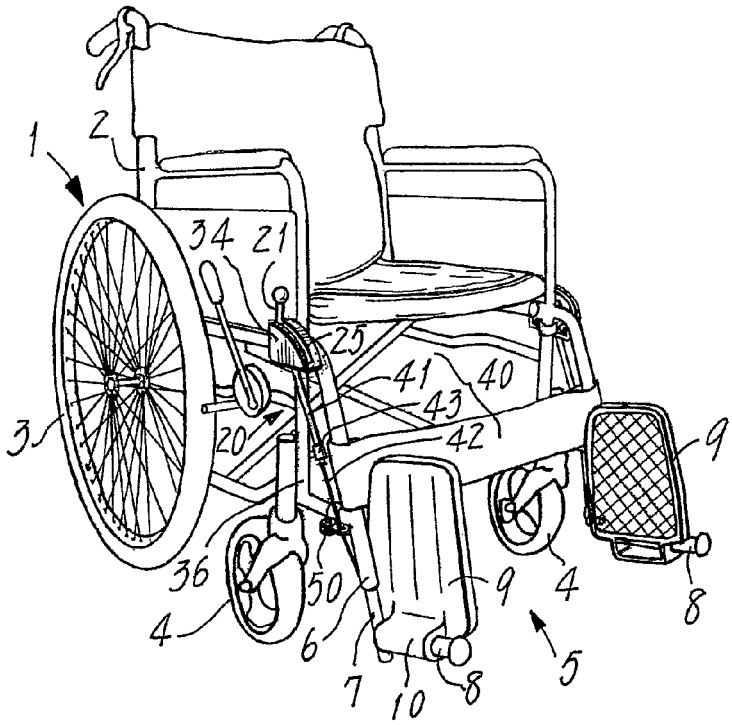
FIG. 3 is a perspective view of the principal parts of the wheelchair, whose footrests are in an open state so that foot plates thereof stand upright.
Figure 4:
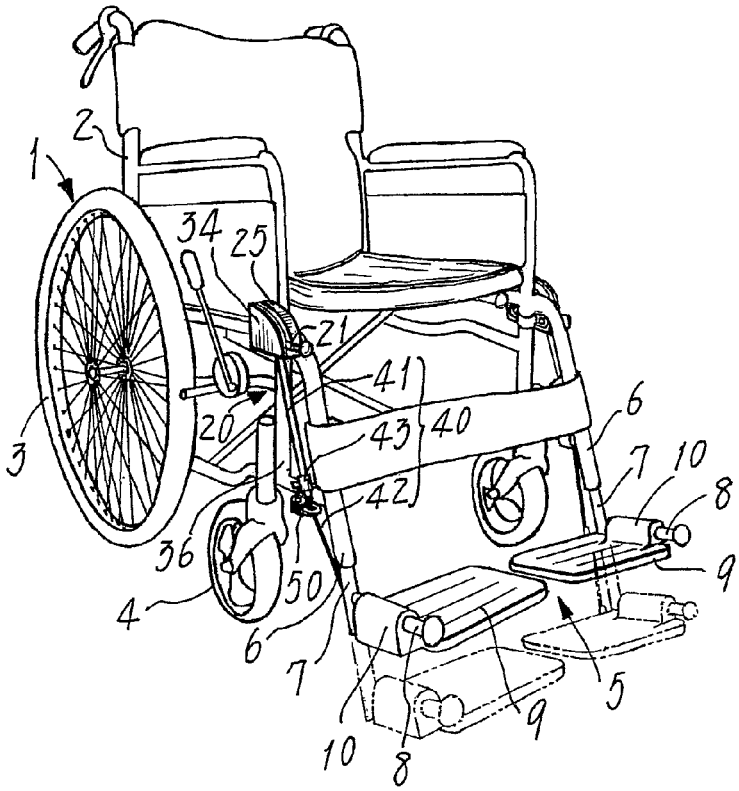
FIG. 4 is a perspective view of said principal parts, but highlighting an adjustment mechanism adapted to alter the height of the foot plates.

Each footrest 5 comprises a lift pipe 7 held in place by a support pipe 6 that extends forwards from a front region of the main frame 2. The lift pipe 7 is capable of taking any desired vertical position relative to the support pipe 6. A pair of longitudinal shafts 8 protrude forwards from the lower ends of the lift pipes 7 so as to bear respective foot plates 9. Each foot plate 9 is pivoted to the shaft 8, at its portion adjacent to its outer lateral side. Both the foot plates 9 can turn between their operative (closed) position where they extend sideways and close to each other and their idle (open) position where they stand upright. The present wheelchair 1 does not differ from the prior art ones in respect of such a basic structure (see FIG. 3). Any known lifting mechanism (not shown) may be built in each support pipe 6 in such a fashion that protrusion length of the lift pipe 7 is variable to raise or lower the foot plate 9 as seen in FIG. 4. Also in this mechanism, there is no difference between the present wheelchair 1 and the existing prior art ones. Therefore, details on this point will not be described here.

Footrest manipulation devices 20 for opening or closing the foot plates 9 independently of each other are disposed on lateral and forward sides of the main frame 2. Each device 20 comprises a manual layer 21 located on one of said sides, and an actuating means 40 keeps the foot plate 9 operatively linked to the corresponding lever. Thus, each foot plate can rotate from the operative (closed) position lying sideways to the upright idle (open) position, or vice versa. Hereinafter, only one of these manipulation devices 20 will be discussed for the sake of simple description.

Figure 5:
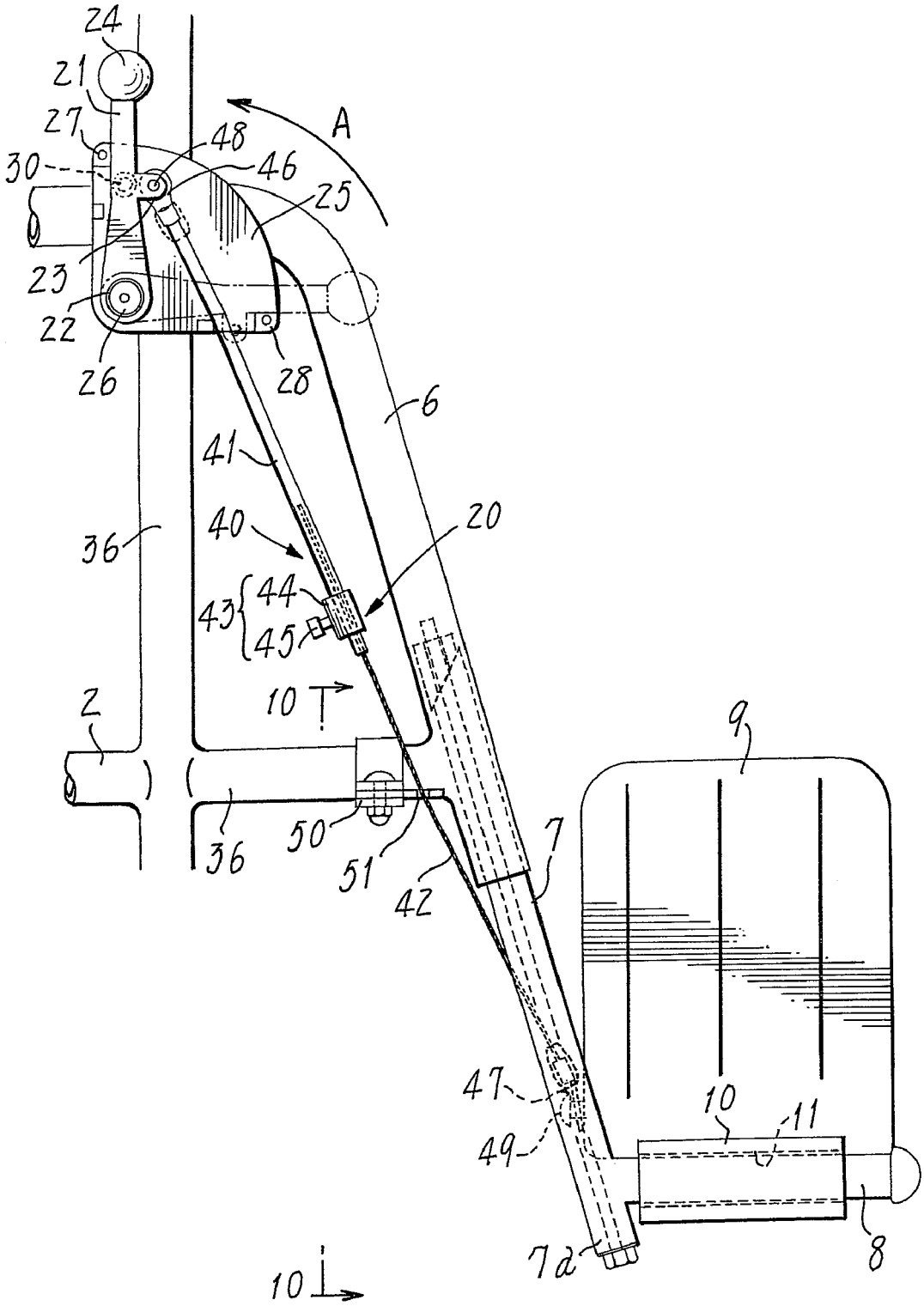
FIG. 5 is a side elevation the manipulation device being operated.

FIG. 5 shows the foot plate 9 which the manipulation device 20 has turned to the upright open (idle) position. A bearing portion 10 is formed at an integral with a side edge of the foot plate 9. A bore 11 penetrating the bearing portion 10 is of an inner diameter slightly or noticeably larger than the diameter of the shaft 8. A clearance is thus defined between the inner periphery of bore 11 and the peripheral surface of shaft 8. This clearance will decrease to a remarkable degree a frictional resistance of the shaft that contacts the foot plate 9 then rotating. With the manual lever 21 being operated to relax the actuating means, the foot plate 9 will smoothly revolve about the shaft 8 due to gravitational force, consequently returning to its transverse closed (operative) position.

As shown in FIGS. 5 to 8, the manual lever 21 is provided as a unit that comprise a base 25 and a cover 34, and these base and cover sandwich between them a body of the lever. The lever 21 made for example of a suitable light metal such as aluminum alloy has at its bottom an engagement hole 22 and a knob 24 at its top. An ear 23 protrudes from an intermediate portion between the bottom and top of the lever body 21. This ear is connected to a resilient tube 41 of the actuating means 40 that will be detailed below.

The base 25 of manual lever is a molded piece of a hard polyvinyl chloride resin and has a quadrant contour. Protruding from a corner that radially forces the quadrant is a stud 26 fitted in the engagement hole 22 of manual lever 21. Stoppers 27 and 28 are formed respectively at and integral with two further corners including and adjacent to the opposite ends of quadrant. One of those stoppers 27 limits the operative position, with the other 28 limiting the relaxed position of the manual lever 21. Formed in the vicinities of those stoppers 27 and 28 are round apertures 29 for holding therein the ball plunger 30. This plunger serves to keep manual lever at its operative position. As will be seen in FIG. 7, a compression spring 31 urges a ball 32 to engage with one of dimples 33 that is formed in a side of the lever body 21 so that the latter is retained at a selected one of the two positions noted above. Such a ball plunger is well known in the art and used widely in various machines and apparatuses. When assembling the manual lever unit, the engagement hole 22 of lever body 21 will be fitted at first on the stud 26 of base 25. The manual lever thus combined with the base is capable of rotation about the stud 26. Subsequently, setscrews 35 will be fastened to fix the cover 35 on the base 25 accompanied by the lever 21.

Figure 6:
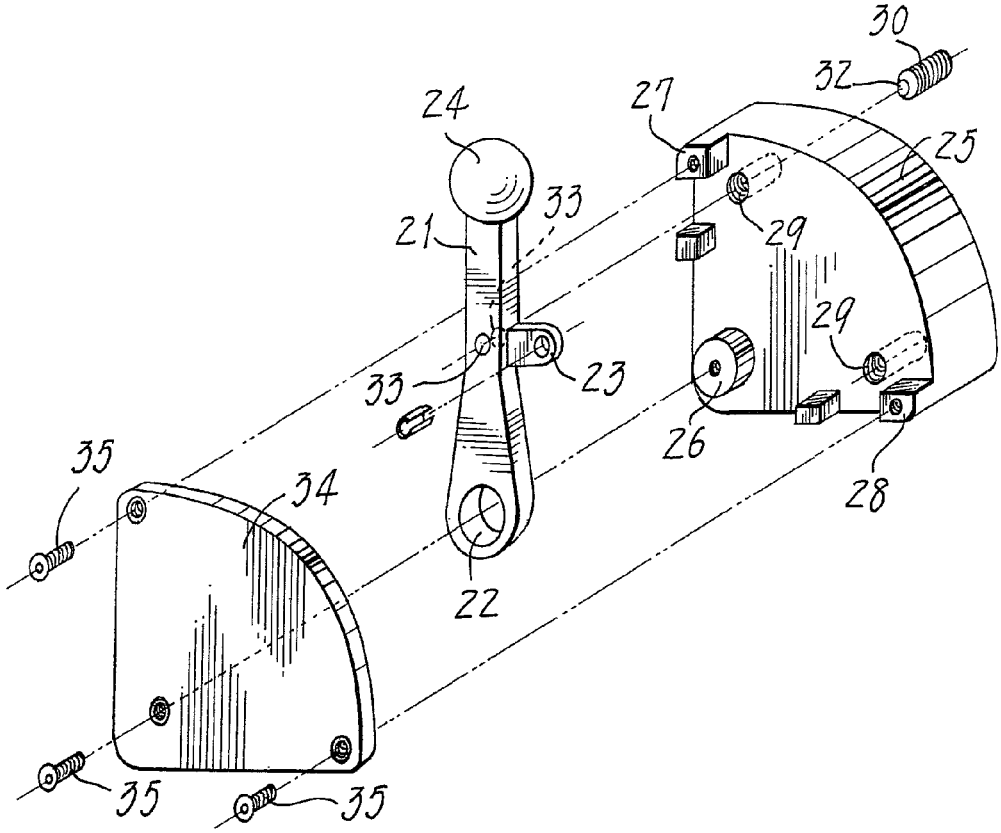
FIG. 6 is an exploded perspective view of a manual lever unit included in said device.
Figure 7:
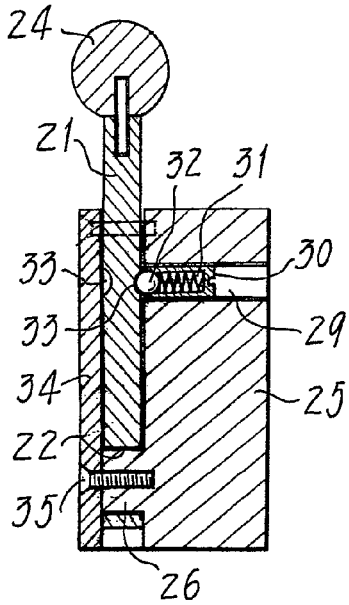
FIG. 7 is a cross-sectional side elevation of the manual lever unit assembled.

As shown in FIGS. 6 and 7, such two dimples 33 are formed respectively in the two lateral sides located opposite to each other transversely of the wheelchair. This design will enable one and the same manual lever unit to be attached to either side, left-hand or right-hand, of the frame 2. Each of the base 25 and the cover 34 is of a shape symmetrical with respect to the stud 26. Therefore, the ball plunger 30 may be installed in the round aperture 29 for the stopper 27 limiting the operative position, or the other aperture for the other stopper 28.

Figure 8:
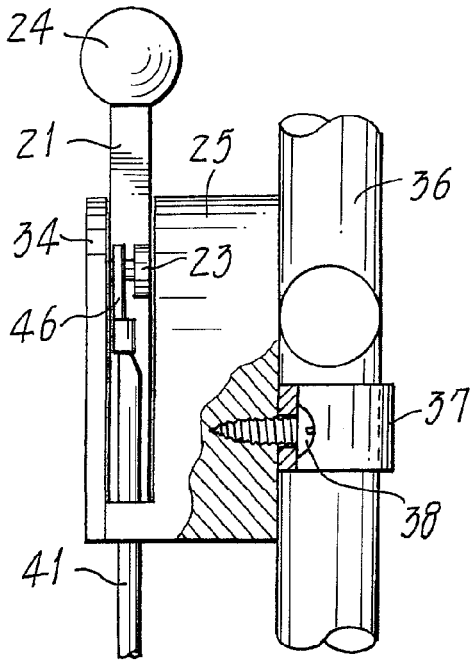
FIG. 8 is a side elevation of said lever unit attached to a main frame of the wheelchair, with some portions being cut off.

The base 25 of manual lever unit of the structure described above may be fixedly attached to a forward frame pipe 36 of main frame 2. A band 37 and setscrews 38 are used for this purpose as shown in FIG. 8. Alternatively, the manual lever base 25 may be mounted on a side wall that is located near an armrest also included in the main frame 2.

Figure 9:
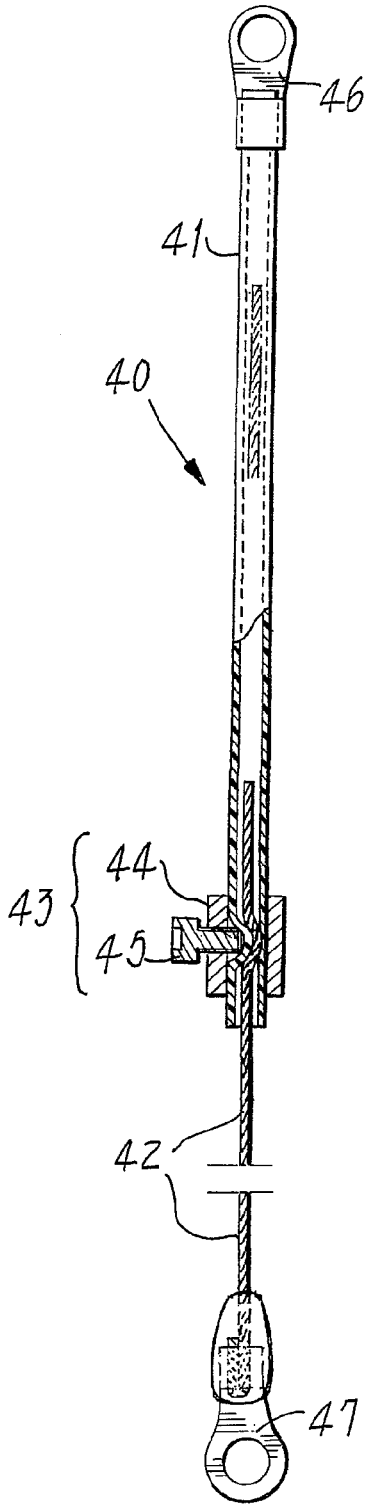
FIG. 9 is a front elevation of an actuating means included in the manipulation device and shown partly in cross section.

FIG. 9 illustrates an example of the actuating means 40 that operatively connects the manual lever 21 to the foot plate 9. This actuating means 40 comprises a resilient elastic tube 41 and a metal wire 42 inserted therein. The wire 42 is capable of sliding inside the tube 41, and the actuating means 40 does further comprise a setting retainer 43 for setting in position the wire to vary its exposed length. The resilient tube 41 is moderately bendable, and preferably formed of a pressure-resistant and waterproof polyurethane resin. This tube 41 made of such a resin is expandable such that it yielding elongates itself when a tension applied thereto exceeds the level of a normal operational force (e.g., 3 Kg). Such a normal external force imparted to the manual lever will never elongate the resilient tube 41 to any noticeable extent. The fastener or setting retainer 43 comprises a metal tubular member 44 fitted on and secured to a lower end of said tube 41. The tubular member 44 is pierced with a setscrew 45 that is another constituent part of said retainer 43. This setscrew thrusts strongly and sideways a portion of the metal wire 42 across the resilient tube fitted thereon. An upper end of resilient tube 41 thus fixed on the wire 42 is secured to a connector 46 having an eye, whilst this wire is secured at its lower end to another connector 47 also having an eye.

Figure 10:
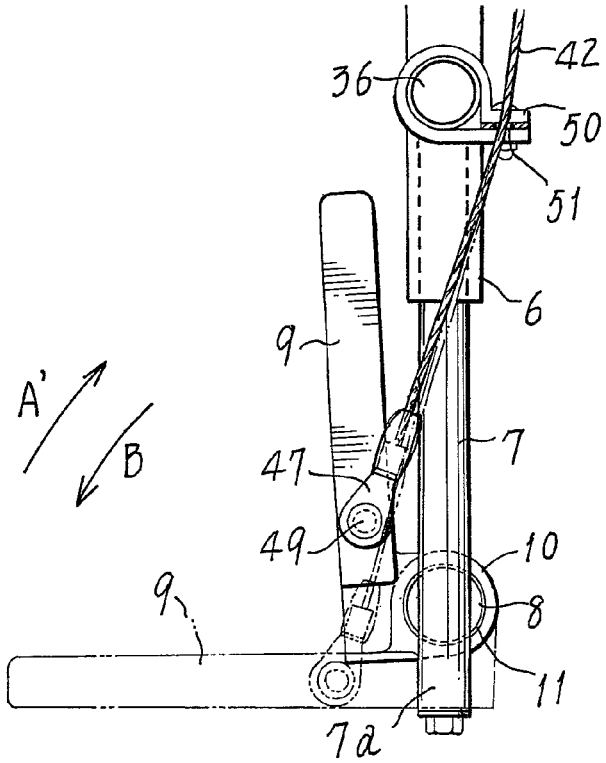
FIG. 10 is a fragmentary rear elevation of the parts shown as viewed from the line 10-10 in FIG. 5.
Figure 11:
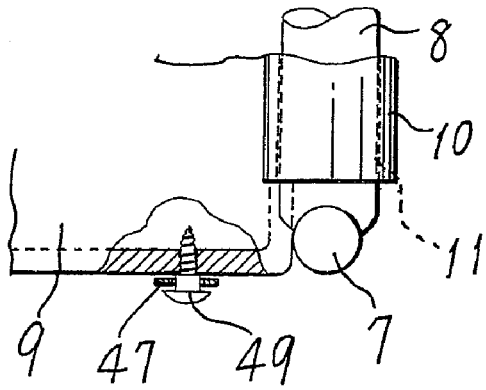
FIG. 11 is a fragmentary plan view of one of the foot plates having turned sideways to take a closed position.
Figure 12:
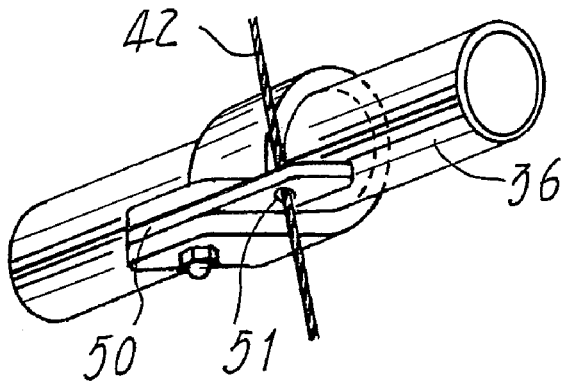
FIG. 12 is a perspective view of the guide for a metal wire included in the manipulation device and shown together with relevant parts.

The connector 46 of tube 41 constituting the described actuating means 40 is pinned 48 to the ear 23 of manual lever 21. The another connector 47 of wire 42 is fastened to a rear portion of the foot plate 9 with a further setscrew 49 as seen in FIGS. 5, 10 and 11. In detail, the rear portion is in close proximity to the longitudinal shaft 8, and the setscrew 49 permits the connector 47 to rotate relative to the foot plate 9 thus linked to said manual lever 21. FIGS. 5 and 12 show that the wire 42 is guided at its middle height through a hole or eyelet 51 of the guide plate 50 that is fixed to the frame pipe 36. Thus, the metal wire 42 is not only protected from quaking sideways, but also normally aligned generally straight with the resilient tube 41. Any remarkable slackness is surely avoided in the unity of these resilient tube and metal wire 42. Since the unity would not catch any foreign articles or otherwise cause any other problems, and by virtue of these features the operability of manual lever 21 is enhanced.

FIGS. 2 and 5 show the footrest manipulation device 20, wherein its manual lever 21 has just been shifted to the operative position. In this instance, the foot plate 9 has been pulled up with the resilient tube 41 and metal wire 42 in such a manner as rotating about the shaft 8 to its upright open (idle) position. It will be seen in FIGS. 7 and 8 that the lever 21 at such a position is retained in place by the ball plunger 30 so as not to permit the foot plate 9 to fall down. With both the foot plates 9 and 9 being put away in this manner, a user can easily get on or off this wheelchair 1.

The user having rested on the seat of wheelchair 1 may push forwards and downwards the manual lever 21 to take its inoperative position bearing against the stopper 28. With a tension that has been working in the tube 41 and wire 42 being now released, gravitational force allows the foot plate 9 having stood upright to tilt around the shaft 8. Such a displacement of said foot plate 9 is so smooth as almost free from frictional resistance against rotation, whereby both the foot plates return to their closed (operative) position, lying sideways and close to each other. As seen in FIGS. 10 and 11, each foot plate 9 thus resting at its closed position will have its lateral side region (near the bearing portion 10) contacting the lower end 7*a* of lift pipe 7. Thus, both the adjacent foot plates 9 will remain sideways and lie stable at their closed (operative) position, so that the user of this wheelchair can drive or otherwise use it with his or her feet rested on those foot plates.

Any users with their feet laid on said plates just noted above and as illustrated in FIG. 1 might accidentally and forcibly operate the manual lever 21. On such an occasion, the tube 41 stretches itself out to cancel or attenuate any abnormal stress which said lever 21 is applying to this tube. The manipulation device does not suffer from damage, injury or the like due to such an abnormal external force. There may be another occasion that said users doing the forcible operation as mentioned above would remove their feet from the foot plates 9. In such an event, the resilient tube 41 shrinks gently to hinder said plates from leaping up, thus eliminating danger and improving safety of this wheelchair.

If and when the foot plates 9 have to be adjusted in height, the setscrew 45 of retainer 43 will be unfastened at first to loosen the actuating means 40. Then, the wire 42 is handled to change its length exposed out of the tube 41, without affecting straight alignment thereof and smooth operability of the manual lever 21. Such a stable liner orientation of those tube 41 and wire 42 will advantageous ensure a safe handling of wheelchair, and in particular the users' hands, fingers or other foreign articles are protected from undesirably getting entangled with said tube 41 or wire 42.

The invention claimed is:

1. A manipulation device for wheelchair footrests that are disposed at a frontal portion of a main frame, and the wheelchair comprising a pair of shafts extending forwards from opposite forward and lateral regions of the main frame and a pair of foot plates pivoted at lateral end portions thereof to the shafts, and the manipulation device further comprising manual levers also disposed at the lateral regions of said main frame and actuating means that operatively connect the manual levers to the foot plates, so that the foot plates are allowed to turn between an operative (closed) position where they extend sideways close to each other and an upright idle (open) position where they are ready to support the feet of a user, the actuating means substantially consisting of a resilient tube, a metal wire and a setting retainer that serves to secure the resilient tube to the metal wire, wherein the tube is capable of elongation in response to an extraordinary tension exceeding a normal stress imparted to said tube, and wherein the wire is loosely inserted in the tube to such an adjustable extent as to alter an exposed length of said wire, with an end of each metal wire being connected to a rear portion of the foot plate, with the rear portion located adjacent to the shaft that holds and pivots said foot plate, and with an end of each resilient tube being connected to the manual lever, whereby the manual lever is operable to pull up the tube united with the wire in such a manner that the foot plate rotates and rises to the upright idle position.

2. A manipulation device as defined in claim 1, wherein a clearance is provided between the outer periphery of the forward extending shaft and the inner peripheral surface of a hole that penetrates each foot plate to form therein a pivot portion, so that a frictional resistance against rotation of the foot plate relative to the shaft is reduced, whereby when the manual lever is relaxed, each foot plate spontaneously rotates due to gravitational force to thereby return to the transverse operative (closed) position.

3. A manipulation device as defined in claim 1, wherein the manual lever is fixed on a base and capable of rotating an angle, with the base being attached either to a frame pipe or a side wall adjacent to an armrest, and further comprising a retaining member fixed in the base so as to hold in place the manual lever when the tube and the wire are pulled.

4. A manipulation device as defined in claim 3, wherein the setting retainer comprises a tubular member fitted on the resilient tube and a setscrew fastened sideways to the tubular member so that an end of the setscrew is in a pressed contact with the tube, whereby the end thrusts across the tube the wire to be secured thereto.

5. A manipulation device as defined in claim 3, wherein the resilient tube is attached at an end thereof to a connector having an eyelet, with the connector being secured to the manual lever and capable of rotation relative thereto, and wherein the metal wire is attached to an end thereof to a further connector also having an eyelet, with the connector being secured to the foot plate at the rear portion thereof and capable of rotation relative thereto, with the wire having a middle portion inserted through an eyelet of a guide plate that is fixed on a frame pipe of the main frame so that the tube is aligned generally straight with the wire.

* * * * *